US007526430B2

(12) United States Patent
Kato et al.

(10) Patent No.: US 7,526,430 B2
(45) Date of Patent: Apr. 28, 2009

(54) SPEECH SYNTHESIS APPARATUS

(75) Inventors: Yumiko Kato, Neyagawa (JP); Takahiro Kamai, Souraku-gun (JP)

(73) Assignee: Panasonic Corporation, Osaka (JP)

( * ) Notice: Subject to any disclaimer, the term of this patent is extended or adjusted under 35 U.S.C. 154(b) by 539 days.

(21) Appl. No.: 11/226,331

(22) Filed: Sep. 15, 2005

(65) Prior Publication Data

US 2006/0009977 A1 Jan. 12, 2006

Related U.S. Application Data

(63) Continuation of application No. PCT/JP2005/006681, filed on Apr. 5, 2005.

(30) Foreign Application Priority Data

Jun. 4, 2004 (JP) ..... 2004-167666

(51) Int. Cl.
*G10L 13/06* (2006.01)
*G10L 21/00* (2006.01)

(52) U.S. Cl. ..... 704/267; 704/260; 704/275; 704/268; 704/273; 704/258; 700/83; 706/21; 715/716; 381/13

(58) Field of Classification Search ..... 704/260, 704/275, 268, 273, 258; 700/83; 706/21; 715/716; 381/13
See application file for complete search history.

(56) References Cited

U.S. PATENT DOCUMENTS 6,226,614 B1 * 5/2001 Mizuno et al. ..... 704/260
6,400,996 B1 * 6/2002 Hoffberg et al. ..... 700/83
6,418,424 B1 * 7/2002 Hoffberg et al. ..... 706/21
6,665,641 B1 * 12/2003 Coorman et al. ..... 704/260
6,738,744 B2 * 5/2004 Kirovski et al. ..... 704/273
6,850,252 B1 * 2/2005 Hoffberg ..... 715/716
7,219,061 B1 * 5/2007 Erdem et al. ..... 704/268

(Continued)

FOREIGN PATENT DOCUMENTS

JP 09-244678 9/1997

(Continued)

OTHER PUBLICATIONS

Mitsuhiro Hatada et al., "A Study on Digital Watermarking Based on Process of Speech Production", Dept. of Electronics, Information and Communication Eng., Waseda Univ., No. 43, pp. 37-42, May 23, 2002, with English Abstract.

(Continued)

*Primary Examiner*—Vijay B Chawan
*Assistant Examiner*—Michael C Colucci
(74) *Attorney, Agent, or Firm*—Wenderoth, Lind & Ponack, L.L.P.

(57) ABSTRACT

A speech synthesis apparatus, which can embed unchangeable additional information into synthesized speech without causing a deterioration of speech quality and restriction by bands, includes a language processing unit which generates synthesized speech generation information necessary for generating synthesized speech in accordance with a language string, a prosody generating unit which generates prosody information of speech based on the synthesized speech generation information, and a waveform generating unit which synthesizes speech based on the prosody information, in which the prosody generating unit embed code information as watermark information in the prosody information of a segment having a predetermined time duration within a phoneme length including a phoneme boundary.

18 Claims, 13 Drawing Sheets

U.S. PATENT DOCUMENTS

| | | | | |
|---|---|---|---|---|
| 2002/0055843 | A1* | 5/2002 | Sakai | 704/258 |
| 2003/0009338 | A1* | 1/2003 | Kochanski et al. | 704/260 |
| 2003/0055653 | A1* | 3/2003 | Ishii et al. | 704/275 |
| 2006/0153390 | A1* | 7/2006 | Iwaki et al. | 381/13 |

FOREIGN PATENT DOCUMENTS

| | | |
|---|---|---|
| JP | 11-296200 | 10/1999 |
| JP | 2000-010581 | 1/2000 |
| JP | 2000-075883 | 3/2000 |
| JP | 2001-305957 | 11/2001 |
| JP | 2002-297199 | 10/2002 |
| JP | 2003-295878 | 10/2003 |

OTHER PUBLICATIONS

Yasushi Konagai et al., "A Study on Digital Watermark based on Process of Speech Production", Dept. of Electronics, Information and Communication Eng., Waseda Univ., vol. 2001, p. 208, Mar. 7, 2001, with English Translation.

* cited by examiner

SPEECH SYNTHESIS APPARATUS

CROSS REFERENCE TO RELATED APPLICATION

This is a continuation of PCT Application No. PCT/JP2005/006681, filed on Apr. 5, 2005.

BACKGROUND OF THE INVENTION (1) Field of the Invention

The present invention relates to a speech synthesis apparatus, in particular to an audio synthesis apparatus which can embed information.

(2) Description of the Related Art

Following a recent development of digital signal processing technology, a method of embedding watermark information using a phase modulation, an echo signal or an auditory masking has been developed for the purposes of preventing illegal copying of acoustic data, particularly music data, and of protecting copyrights. It is for guaranteeing that information is embedded into the acoustic data generated as content and only an authorized rights holder can use the content by a reproducing appliance to read out the information.

On the other hand, speech is not only speech data generated by human speeches but also speech data generated by a so-called speech synthesis. The speech synthesis technology which converts a character-string text into speech has been developed remarkably. A synthesized speech which well includes characteristics of a speaker recorded on a speech database, which becomes a basis, can be generated in a system of synthesizing speech using a speech waveform stored in a speech database without processing the speech waveform or in a system which constructs a control method of controlling a parameter of each frame using a statistic learning algorithm from a speech database such as a speech synthesis method using a Hidden Markov Model (HMM). That is to say, the synthesized speech allows disguising oneself as the speaker.

In order to prevent such arrogation, in the method of embedding information into the synthesized speech for each piece of audio data, it is significant not only to protect the copyrights such as for music data, but also to embed information, into the synthesized speech, for identifying the synthesized speech and a system used for the audio synthesis, and the like.

As a conventional method of embedding information into synthesized speech, there is a method of outputting synthesized speech by adding identification information for identifying that the speech is the synthesized speech by changing signal power in a specific frequency band of the synthesized speech, in a frequency band in which a deterioration of sound quality is difficult to be sensed when a person hears, that is outside the main frequency band of the speech signal (e.g. refer to First Patent Reference: Japanese Patent Publication No. 2002-297199 (pp. 3 to 4 , FIG. 2)). FIG. 1 is a diagram for explaining the conventional method of embedding information into synthesized speech as disclosed in the First Patent Reference. In a speech synthesis apparatus 12, a synthesized speech signal outputted from a sentence speech synthesis processing unit 13 is inputted to a synthesized speech identification information adding unit 17. The synthesized speech identification information adding unit 17 then adds identification information indicating that the synthesized speech signal is different from a speech signal generated by human speech to the synthesized speech signal, and outputs as a synthesized speech signal 18. On the other hand, in a synthesized speech identifying apparatus 20, an identifying unit 21 detects from the input speech signal about whether or not there is identification information. When the identifying unit 21 detects identification information, it is identified that the input speech signal is the synthesized speech signal 18 and the identification result is displayed on the identification result displaying unit 22.

Further, in addition to the method of using signal power in a specific frequency band, in a speech synthesis method of synchronizing waveforms for one period into a pitch mark and synthesizing into speech by connecting the waveforms, there is a method of adding information to speech by slightly modifying waveforms for a specific period at the time of connecting waveforms (e.g. refer to Second Patent Reference: Japanese Patent Publication No. 2003-295878). The modification of waveforms is setting an amplitude of the waveform for a specific period to a different value that is different from prosody information that is originally to be embedded, or switching the waveform for the specific period to a waveform whose phase is inverted, or shifting the waveform for the particular period from a pitch mark to be synchronized for a very small amount of time.

On the other hand, as a conventional speech synthesis apparatus, for the purpose of improving clarity and naturalness of speech, there is a speech synthesis apparatus which generates a fine time structure called micro-prosody in a fundamental frequency or in a phoneme in speech strength, that is found in natural speech of human speaking (e.g. refer to Third Patent Reference: Japanese Patent Publication No. 09-244678, and Fourth Patent Reference: Japanese Patent Publication No. 2000-10581). A micro-prosody can be observed within a range of 10 milliseconds to 50 milliseconds (at least 2 pitches or more) before or after phoneme boundaries. It is known from research papers and the like that it is very difficult to hear the distinctions within the range. Also, it is known that the micro-prosody hardly affects characteristics of a phoneme. As a practical observation range of micro-prosody, a range between 20 milliseconds to 50 milliseconds is considered. The maximum value is set to 50 milliseconds because experience shows that the length longer than 50 milliseconds may exceed a length of a vowel.

SUMMARY OF THE INVENTION

However, in an information embedding method of the conventional structure, a sentence speech synthesis processing unit 13 and a synthesized speech identification information adding unit 17 are completely separated and a speech generating unit 15 adds identification information after generating a speech waveform. Accordingly, by only using the synthesized speech identification information adding unit 17, same identification information can be added to speech synthesized by another speech synthesis apparatus, recorded speech, or speech inputted from a microphone. Therefore, there is a problem that it is difficult to distinguish a synthesized speech 18 synthesized by the speech synthesis apparatus 12 and speech including human voices generated by another method.

Also, the information embedding method of the conventional structure is for embedding identification information into speech data as a modification of frequency characteristics. However, the information is added to a frequency band other than a main frequency band of a speech signal. Therefore, in a transmission line such as a telephone line in which a transmitting band is restricted to the main frequency band of the speech signal, there are problems that the added information may be dropped off during the transmission, and that a large deterioration of sound quality is caused by adding information within a band without drop-offs, that is, within the main frequency band of the speech signal.

Further, in a method of modifying a waveform of specific one period when the waveform of one period is synthesized a conventional pitch mark, while there is no influence from the frequency band of the transmission line, the control is performed in a small time unit of one period and it is necessary to keep an amount of modification of the waveform in a modification as small as a modification by which humans do not feel the deterioration of sound quality and notice the modification. Therefore, there is a problem that the additional information may be dropped off or buried in a noise signal during a process of digital/analog conversion or transmission.

Considering the problems mentioned above, the first objective of the present invention is to provide a speech synthesis apparatus which can surely identify the synthesized speech from speech generated by another method.

Further, the second objective of the present invention is to provide a speech synthesis apparatus by which the embedded information is never lost when the band is restricted in the transmission line, when rounding is performed at the time of digital/analog conversion, when the signal is dropped off in the transmission line, or when the noise signal is mixed.

In addition, the third objective of the present invention is to provide a speech synthesis apparatus that can embed information into synthesized speech without causing the deterioration of sound quality. A speech synthesis apparatus according to the present invention is the speech synthesis apparatus which synthesizes speech along with a character string, the apparatus including: a language processing unit which generates synthesized speech information necessary for generating synthesized speech along with the character string; a prosody generating unit which generates prosody information of the speech based on the synthesized speech generation information; and a synthesis unit which synthesizes the speech based on the prosody information, wherein said prosody generating unit embeds code information as watermark information into the prosody information of a segment having a predetermined duration within a phoneme length including a phoneme boundary.

According to this structure, the code information as watermark information is embedded into the prosody information of a segment having a predetermined time length within a phoneme length including a phoneme boundary, which is difficult to operate for other than a process of synthesizing speech. Therefore, it can prevent from adding the code information to speech other than the synthesized speech such as speech synthesized by other speech synthesis apparatus and human voices. Consequently, inputted speech can be surely identified from speech generated by other methods.

It is preferred for the prosody generating unit to embed the code information into a time pattern of a speech fundamental frequency.

According to this structure, by embedding information into the time pattern of a speech fundamental frequency, the information can be held in a main frequency band of a speech signal. Therefore, even in the case where the signal to be transmitted is restricted to the main frequency band of the speech signal, the synthesized speech to which the identification is added can be transmitted without causing a drop off of information and deterioration of sound quality by adding information.

Further preferably, the code information is indicated by micro-prosody.

The micro-prosody itself is fine information whose differences cannot be identified with human ears. Therefore, the information can be embedded into a synthesized speech without causing the deterioration of sound quality.

It should be noted that the present invention can be realized as a speech synthesis identifying apparatus which extracts code information from the synthesized speech synthesized by the speech synthesis apparatus and identifies whether or not inputted speech is the synthesized speech, and as an additional information reading apparatus which extracts additional information added to the synthesized speech as the code information.

For example, a synthesized speech identifying apparatus is a synthesis speech identifying apparatus which identifies whether or not inputted speech is synthesized speech, said apparatus including: a fundamental frequency calculating unit which calculates a speech fundamental frequency of the inputted speech on a per frame basis, each frame having a predetermined duration; and an identifying unit which identifies, in a segment having a predetermined duration within a phoneme length including a phoneme boundary, whether or not the inputted speech is the synthesized speech by identifying whether or not identification information is included in the speech fundamental frequencies calculated by said fundamental frequency calculating unit, the identification information being for identifying whether or not the inputted speech is the synthesized speech.

Further, an additional information reading apparatus is an additional information reading apparatus which decodes additional information embedded in inputted speech, including: a fundamental frequency calculating unit which calculates a speech fundamental frequency of the inputted speech on a per frame basis, each frame having a predetermined duration; and an additional information extracting unit which extracts, in a segment having a predetermined duration within a phoneme length including a phoneme boundary, predetermined additional information indicated by a frequency string from the speech fundamental frequencies calculated by said fundamental frequency calculating unit.

It should be noted that the present invention can be realized not only as a speech synthesis apparatus having such characteristic units, but also as a speech synthesis method having such characteristic units as steps, and as a program for making a computer function as the speech synthesis apparatus. Also, not to mention that such program can be communicated via a recording medium such as Compact Disc-Read Only Memory (CD-ROM) or a communication network such as Internet.

As further information about technical background to this invention, the disclosure of Japanese Patent Application No. 2004-167666 filed on Jun. 4, 2004 including specification, drawings and claims is incorporated herein by reference in its entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENT(S)

Hereafter, it is explained about embodiments of the present invention with references to drawings.

First Embodiment

Figure 1:
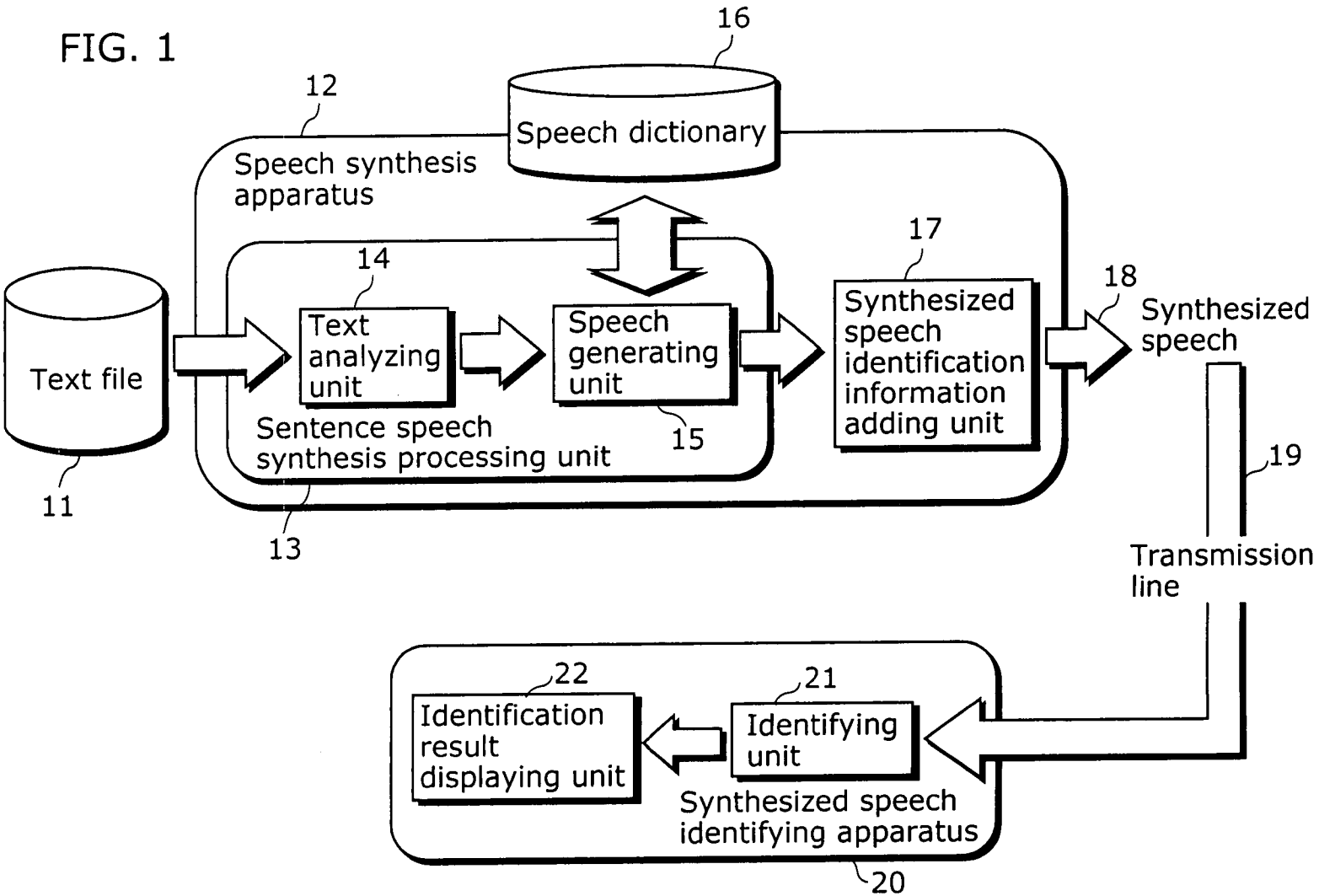
FIG. 1 is a functional block diagram showing a conventional speech synthesis apparatus and synthesized speech identifying apparatus.
Figure 2:
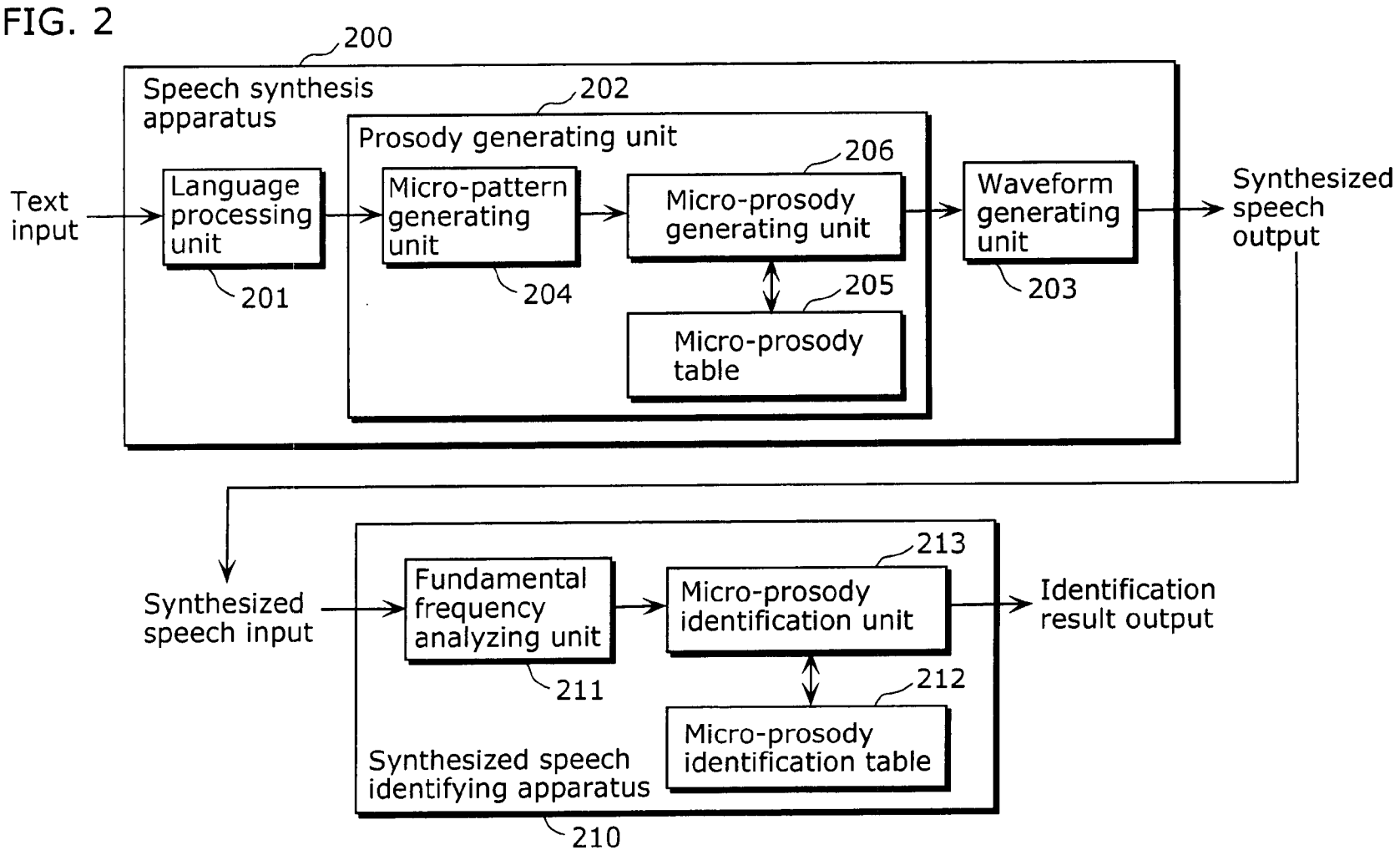
FIG. 2 is a functional block diagram showing a speech synthesis apparatus and a synthesized speech identifying apparatus according to a first embodiment of the present invention.

FIG. 2 is a functional block diagram of a sound synthesis apparatus and a synthesized sound identifying apparatus according to the first embodiment of the present invention.

In FIG. 2, a speech synthesis apparatus 200 is an apparatus which converts inputted text into speech. It is made up of a language processing unit 201, a prosody generating unit 202 and a waveform generating unit 203. The language processing unit 201 performs language analysis of the inputted text, determines the arrangement of morphemes in the text and the phonetic readings and accents according to the syntax, and outputs the phonetic readings, the accents' positions, clause segments and modification information. The prosody generating unit 202 determines a fundamental frequency, speech strength, rhythm, and timing and time length of posing of a synthesis speech to be generated based on the phonetic readings, accents' positions, clause segments and modification information outputted from the language processing unit 201, and outputs a fundamental frequency pattern, strength pattern, and length of duration of each mora. The waveform generating unit 203 generates a speech waveform based on the fundamental frequency pattern, strength pattern and duration length for each mora that are outputted from the prosody generating unit 202. Here, a mora is a fundamental unit of prosody for Japanese speech. A mora is a single short vowel, a combination of a consonant and a short vowel, a combination of a consonant, a semivowel, and a short vowel, or only mora phonemes. Here, a mora phoneme is a phoneme which forms one beat while it is a part of a syllable in Japanese.

The prosody generating unit 202 is made up of a macro-pattern generating unit 204, a micro-prosody table 205 and a micro-prosody generating unit 206. The macro-pattern generating unit 204 determines a macro-prosody pattern to be assigned corresponding to an accent phrase, a phrase, and a sentence depending on the phonetic readings, accents, clause segments and modification information that are outputted from the language processing unit 201, and outputs, for each mora, a duration length of a mora, a fundamental frequency and speech strength at a central point in a vowel duration in the mora. The micro-prosody table 205 holds, for each phoneme and an attribute of the phoneme, a pattern of a fine time structure (micro-prosody) of prosody near a boundary of phonemes. The micro-prosody generating unit 206 generates a micro-prosody with reference to the micro-prosody table 205 based on the sequence of phonemes, accents' positions and modification information outputted by the language processing unit 201, and on the duration length of the phoneme, the fundamental frequency and speech strength outputted by the macro-pattern generating unit 204, applies the micro-prosody to each phoneme in accordance with the fundamental frequency and speech strength at the central point in the duration of the phoneme outputted by the macro-pattern generating unit 204, and generates a prosody pattern in each phoneme.

The synthesized speech identifying apparatus 210 is an apparatus which analyzes the inputted speech and identifies whether or not the inputted speech is the synthesized speech. It is made up of a fundamental frequency analyzing unit 211, a micro-prosody identification table 212, and a micro-prosody identifying unit 213. The fundamental frequency analyzing unit 211 receives the synthesized speech outputted by the waveform generating unit 203 or a speech signal other than the synthesized speech as an input, analyzes a fundamental frequency of the inputted speech, and outputs a value of the fundamental frequency for each analysis frame. The micro-prosody identification table 212 holds, for each manufacturer, a time pattern (micro-prosody) of a fundamental frequency that should be included in the synthesized speech outputted by the speech synthesis apparatus 200. The micro-prosody identifying unit 213, by referring to the micro-prosody identification table 212, judges whether or not the micro-prosody generated by the synthesized speech apparatus 200 is included in the time patterns of the fundamental frequency outputted from the fundamental frequency analyzing unit 211, identifies whether or not the speech is the synthesized speech, and outputs the identification result.

Figure 3:
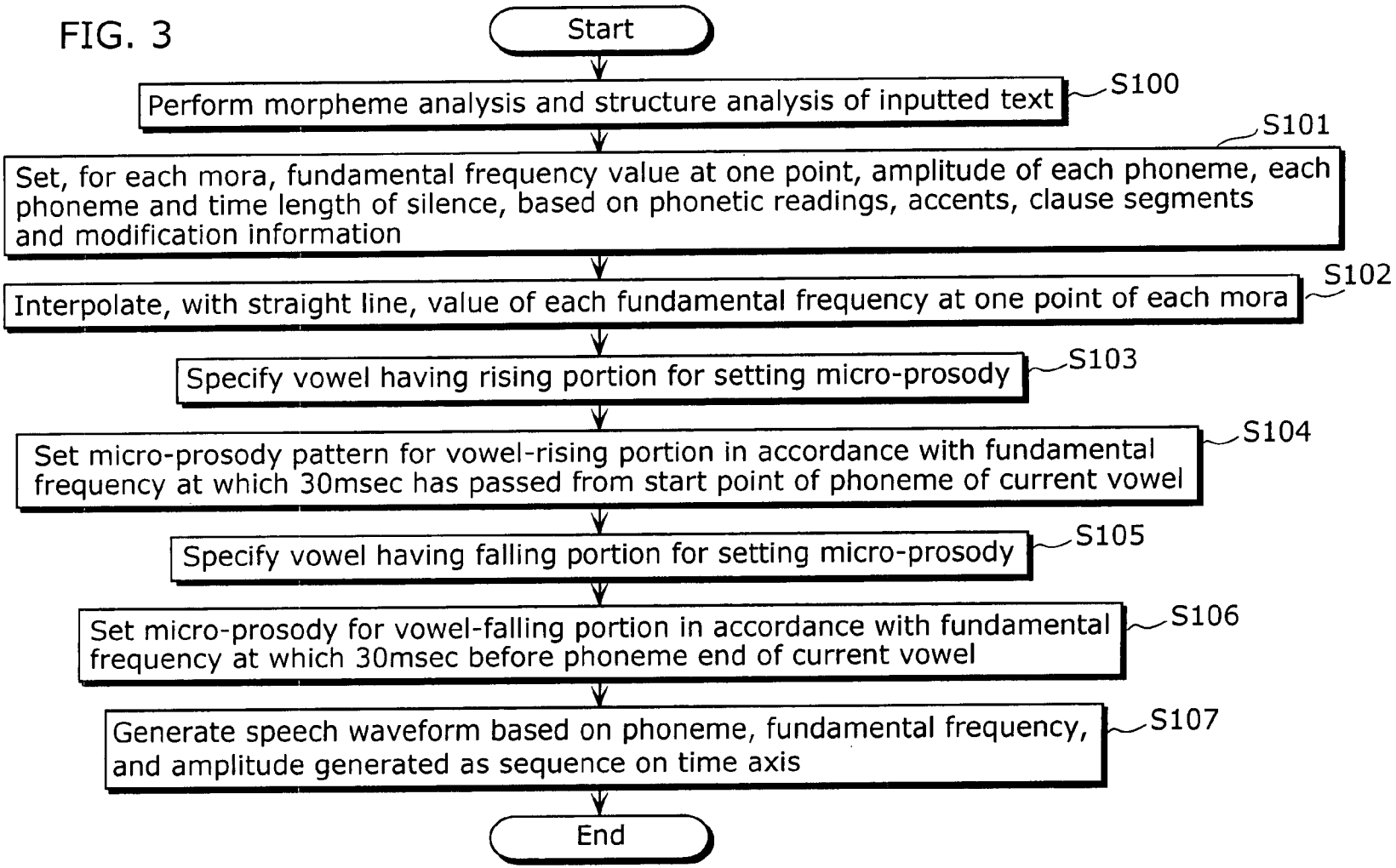
FIG. 3 is a flowchart showing operations by the speech synthesis apparatus according to the first embodiment of the present invention.
Figure 4:
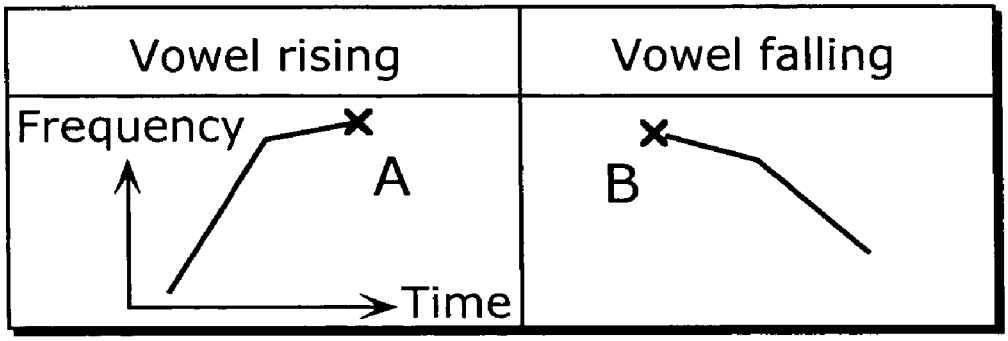
FIG. 4 is a diagram showing an example of a micro-prosody pattern stored in a micro-prosody table in the speech synthesis apparatus according to the first embodiment of the present invention.
Figure 5:
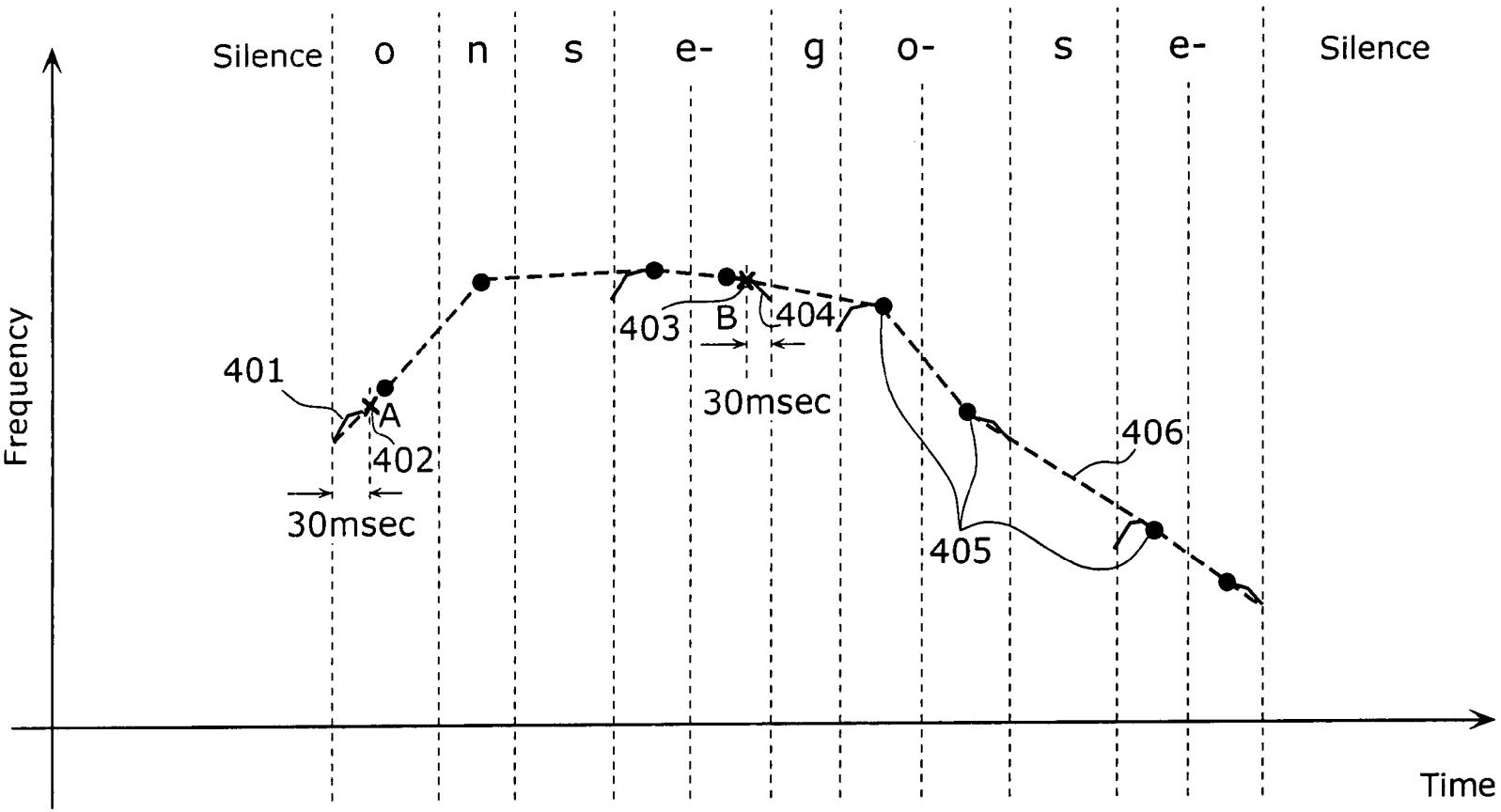
FIG. 5 is a diagram showing an example of a fundamental frequency pattern generated by the speech synthesis apparatus according to the first embodiment of the present invention.
Figure 6:
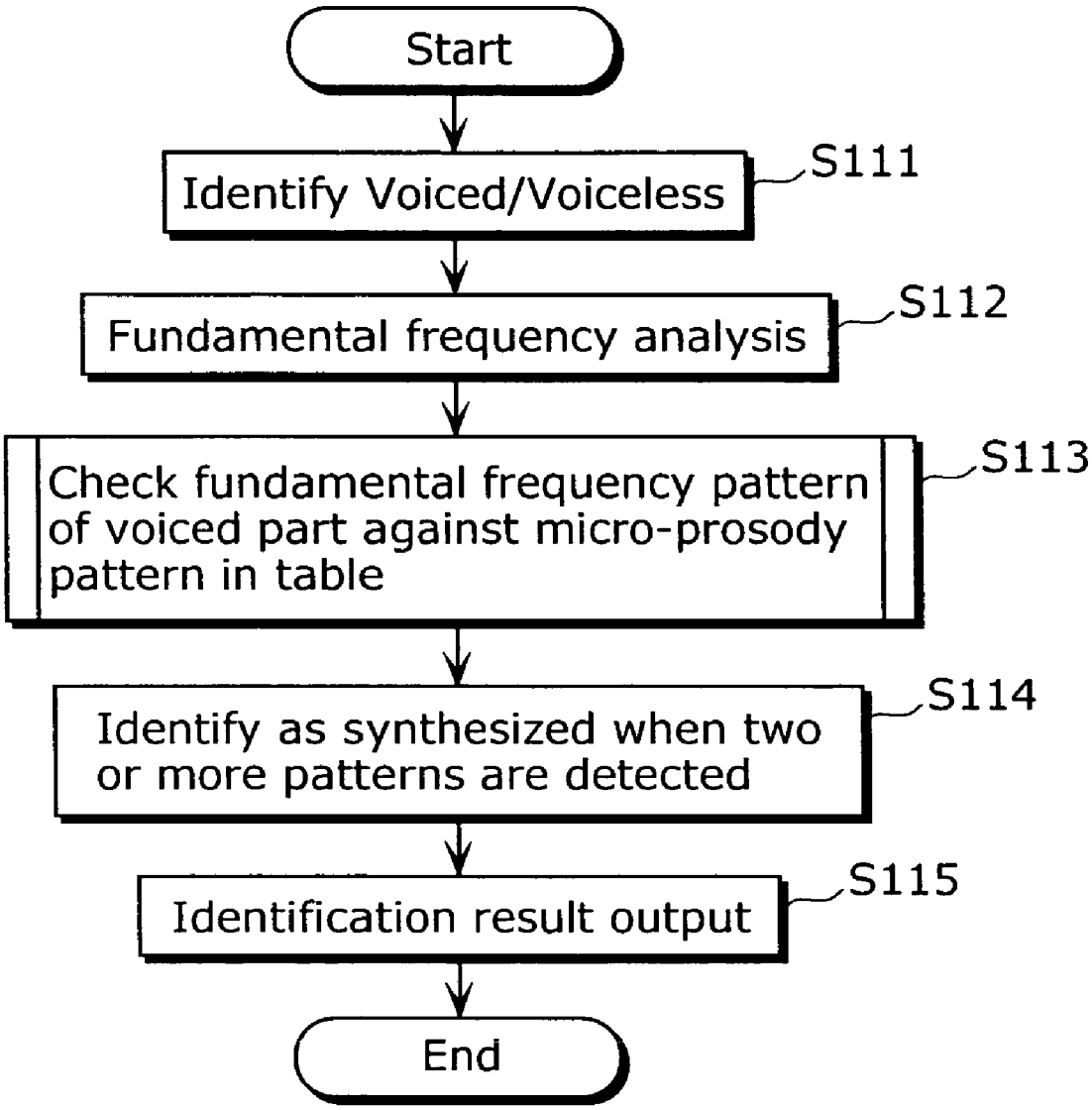
FIG. 6 is a flowchart showing operations by the synthesized speech identifying apparatus according to the first embodiment of the present invention.
Figure 7:
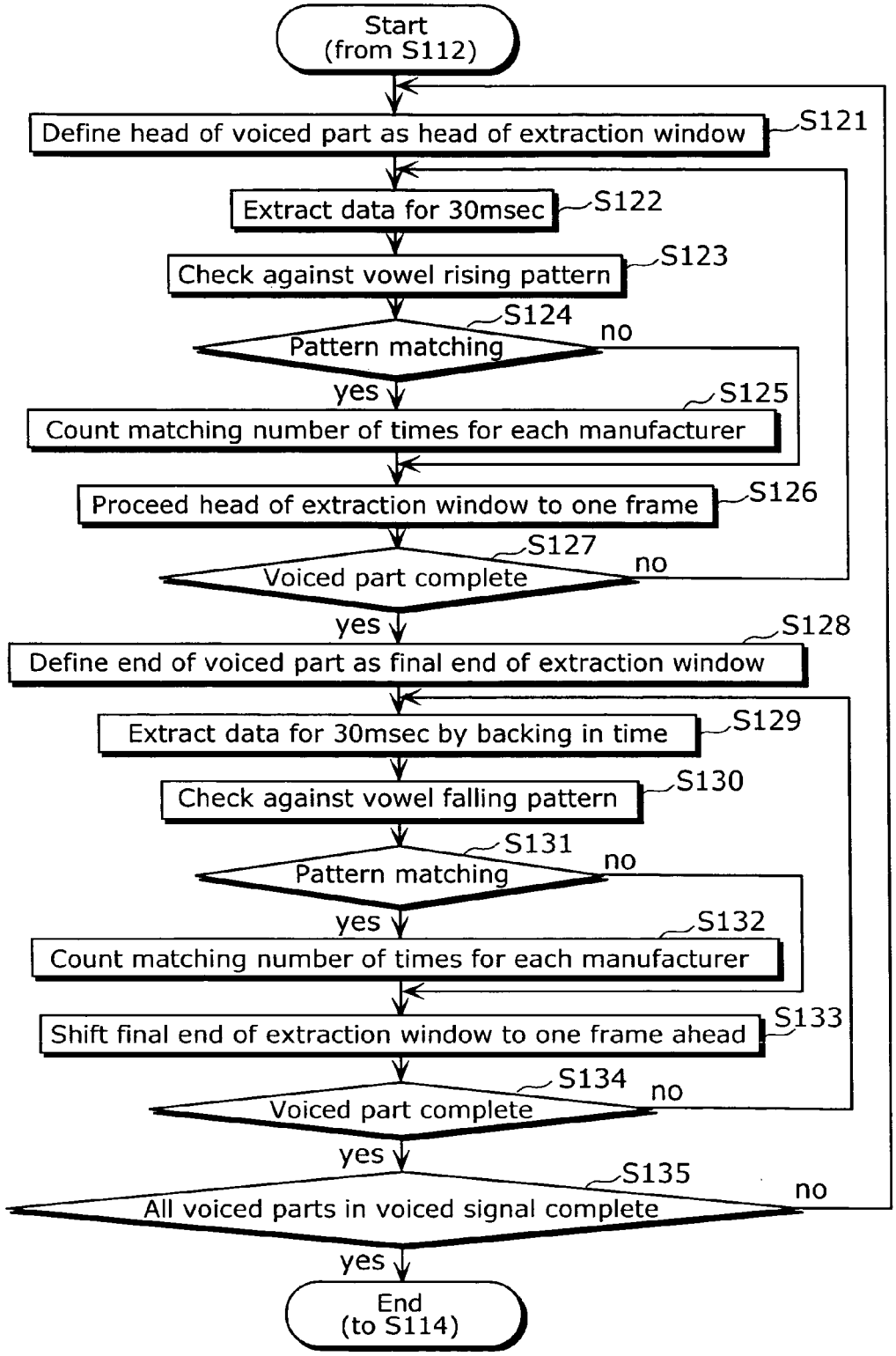
FIG. 7 is a flowchart showing operations by the synthesized speech identifying apparatus according to the first embodiment of the present invention.
Figure 8:
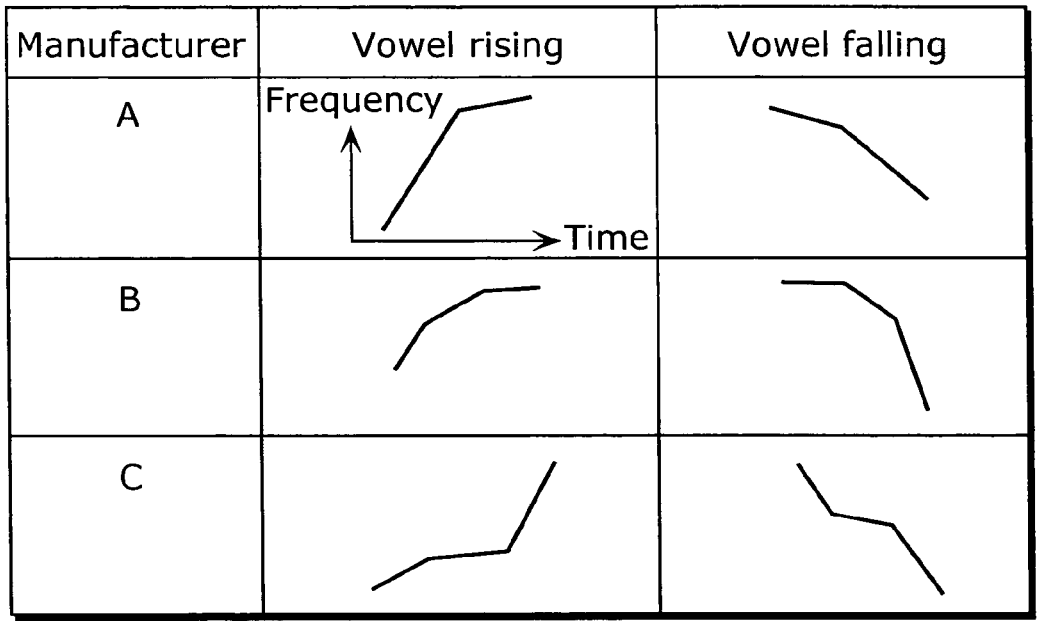
FIG. 8 is a diagram showing an example of contents stored in a micro-prosody identification table in the synthesized speech identifying apparatus according to the first embodiment of the present invention.

Next, it is explained about operations of the speech synthesis apparatus 200 and the synthesized speech identifying apparatus 210. FIG. 3 is a flowchart showing the operations by the speech synthesis apparatus 200. FIG. 6 and FIG. 7 are flowcharts showing the operations by the speech synthesis identifying apparatus 210. It is explained by further referring to the following diagrams: FIG. 4 which shows an example of micro-prosodies of a vowel rising portion and vowel falling portion stored in the micro prosody table 250; FIG. 5 which shows in scheme an example of a prosody generation by the prosody generating unit 202; and FIG. 8 shows an example of the vowel rising portion and vowel falling portion stored for each piece of the identification information in the micro-prosody identification table. The schematic diagram shown in FIG. 5 shows a process of generating prosody using an example of "o n s e- g o- s e-", and shows a pattern of a fundamental frequency on a coordinate whose horizontal axis indicates time and vertical axis indicates frequency. The boundaries of phonemes are indicated with dashed lines and a phoneme in an area is indicated on the top in Romanized spelling. The fundamental frequency, in a unit of mora, generated by the macro-pattern generating unit 204 is indicated in black dot 405. The polylines 401 and 404 indicated with a solid line show micro-prosodies generated by the micro-prosody generating unit 206.

As similar to a general speech synthesis apparatus, the speech synthesis apparatus 200 firstly performs morpheme analysis and structural analysis of the inputted text in the language processing unit, and outputs, for each morpheme, phonetic readings, accents, clause segments and its modification (step S100). The macro-pattern generating unit 204 converts the phonetic reading into a mora sequence, and sets a fundamental frequency and speech strength at a central point of a vowel included in each mora and a duration length of the mora based on the accents, the clause segments and the modification information (step S101). For example, as disclosed in Japanese Patent Publication No. 11-95783, the fundamental frequency and the speech strength are set by generating, in a unit of mora, a prosody pattern of the accent phrase from natural speech using a statistical method, and by generating a prosody pattern of a whole sentence by setting an absolute position of the prosody pattern according to an attribute of the accent phrase. The prosody pattern generated by one point per mora is interpolated with a straight line 406, and fundamental frequency is obtained at each point in the mora (step S102).

The micro-prosody generating unit 205 specifies, among vowels in speech to be synthesized, a vowel which follows immediately after silence, or a vowel which follows immediately after a consonant other than a semivowel (step S103). For the vowel which satisfies the conditions in step S103, a micro-prosody pattern 401 for a vowel rising portion shown in FIG. 4 is extracted with reference to the micro-prosody table 205, for a fundamental frequency at a point 402 where 30 milliseconds (msec) has passed from a starting point of the phoneme out of the fundamental frequencies within the mora obtained by the interpolation with the straight line in step S102 as shown in FIG. 5, and the extracted micro-prosody pattern for the vowel rising portion is connected so as to match the end of the current micro-prosody pattern, and sets a micro-prosody of an applied vowel rising portion (step S104). In other words, a point A in FIG. 4 is connected so as to match the point A in FIG. 5.

Similarly, the micro-prosody generating unit 205 specifies, among vowels in speech to be synthesized, a vowel which immediately precedes silence, or a vowel which immediately precedes a consonant other than the semivowel (step S105). In a falling portion of a specified vowel, for a fundamental frequency 403 that is located 30 msec before the end of the phoneme among frequencies within a mora obtained by the interpolation with a straight line in S102 as shown in FIG. 5, a micro-prosody pattern 404 for vowel falling portion as shown in FIG. 4 is extracted with reference to the micro-prosody table 205. The extracted micro-prosody pattern for the vowel falling portion is connected so as to match with a start of the current micro-prosody pattern, and sets a micro-prosody of the applied vowel falling portion (step S106). In other words, a point B in FIG. 4 is connected so as to match a point B in FIG. 5.

The micro-prosody generating unit 206 outputs, together with a mora sequence, the fundamental frequencies including the micro-prosodies generated in S105 and S106, the speech strength generated by the macro-pattern generating unit 204, and the duration length of a mora.

The waveform generating unit 203 generates a speech waveform using a waveform superposition method or a sound-source filter model and the like based on the fundamental frequency pattern including micro-prosodies outputted by the micro-prosody generating unit 206, the speech strength generated by the macro-pattern generating unit 204, the duration length of a mora, and the mora sequence (S107).

Next, it is explained about operations of the synthesized speech identifying apparatus 210 with references to FIG. 6 and FIG. 7. In the synthesized speech identifying apparatus 210, the fundamental frequency analyzing unit 211 judges whether the inputted speech is a voiced part or a voiceless part, and separates the speech into the voiced part and the voiceless part (step S111). Further, the fundamental frequency analyzing unit 211 obtains a value of a fundamental frequency for each analysis frame (step S112). Next, as shown in FIG. 8, the micro-prosody identifying unit 213, by referring to the micro-prosody identification table 212 in which micro-prosody patterns that are respectively associated with manufactures' names are recorded, checks a fundamental frequency pattern of the voiced part of the inputted speech extracted in S112 against all of the micro-prosody data recorded in the micro-prosody identification table 212, and counts how many times the data matches the pattern for each manufacturer of a speech synthesis apparatus (step S113). In the case where there are two or more micro-prosodies of a specific manufacturer in the voiced part of the inputted speech, the micro-prosody identifying unit 213 identifies that the inputted speech is the synthesized speech, and outputs the identification result (step S114).

With reference to FIG. 7, the operation in step S113 is explained further in detail. First, in order to check a vowel rising pattern of a voiced part which is the head voiced part on a time axis among the voiced parts of the inputted speech identified in S111, the micro-prosody identifying unit 213 sets a top frame at a head of an extraction window (step S121), and extracts a fundamental frequency pattern in a length of the window of 30 msec towards a back on the time axis (step S122). It checks the fundamental frequency pattern extracted in S122 against the vowel rising patterns of all manufacturers recorded in the micro-prosody judgment table 212 shown in FIG. 8 (step S123). In the identification of step S124, in the case where any one of the fundamental frequency patterns in the extraction window matches one of the patterns recorded in the micro-prosody identification table 212 (yes in S124), a value of 1 is added to a count of a manufacturer of which patterns are matched (step S125). In the identification of step S124, in the case where any of the fundamental frequency patterns extracted in S122 does not match one of the vowel rising patterns recorded in the micro-prosody identification table 212 (no in S124), a head of the extraction window is moved for one frame (step S126). Here, one frame is, for example, 5 msec.

It is judged whether or not the extractable voiced part is less than 30 msec (step S127). In this judgment, in the case where the extractable voiced part is less than 30 msec, it is considered as the end of the voiced part (yes in S127), and the end frame of a voiced part which is the head voiced part among the voiced parts on the time axis at the last end of the extraction window in order to continuously check the vowel falling patterns (step S128). A fundamental frequency pattern is extracted in a length of a window of 30 msec dated back on the time axis (step S129). In the case where the extractable voiced part is 30 msec or longer in S127 (no in S127), the fundamental frequency pattern is extracted in a length of a window of 30 msec toward back on the time axis, and the processing from S122 to S127 is repeated. The fundamental frequency pattern extracted in S129 is checked against the vowel rising patterns of every manufacturers recorded in the micro-prosody identification table 212 shown in FIG. 8 (step S130). In the case where the patterns are matched in the judgment of step S131 (yes in S131), a value of 1 is added to a count of a manufacturer of which the patterns are matched (step S132). In the case where the fundamental frequency pattern extracted in S129 does not match any one of the vowel falling patterns recorded in the micro-prosody identification table 212 in step S131 (no in S131), the last end of the extraction window is shifted one frame forward (step S133), and it is judged whether or not the extractable voiced part is less than 30 msec (step S134). In the case where the extractable voiced part is less than 30 msec, it is considered as the end of the voiced part (yes in S134). In the case where the voiced parts identified in S112 are remained, in the inputted speech, after the voiced part on which the checking processing is completed on the time axis (no in S135), a top frame of the next voiced part is set at the head of the extraction window, and the processing from S121 to S133 is repeated. In the case where the extractable voiced part is 30 msec or longer in S134 (no in S134), a fundamental frequency pattern is extracted in a length of a window of 30 msec dated back on the time axis, and the processing from S129 to S134 is repeated.

A match of patterns is identified, for example, by the following method. It is assumed that, in 30 msec in which the speech synthesis apparatus 200 sets a micro-prosody, a micro-prosody pattern in the micro-prosody identification table 212 of the synthesized speech identifying apparatus 210 is indicated, per one frame (e.g. per 5 msec), by a relative value of the fundamental frequency which defines a frequency of a start point of the micro-prosody as 0. The fundamental frequency analyzed by the fundamental frequency analyzing unit 211 is converted into a value for one frame each within a window of 30 msec by the micro-prosody identifying unit 213, and further converted into a relative value based on the value of the head of the window as 0. A relative coefficient between the micro-prosody pattern recorded in the micro-prosody identification table 212 and a pattern in which the fundamental frequency of the inputted speech analyzed by the fundamental frequency analyzing unit 211 is indicated for one frame each is obtained, and it is considered that the patterns are matched when the relative coefficient is 0.95 or greater.

For example, in the case where the synthesized speech outputted by the speech synthesis apparatus 200 of the manufacturer A having the micro-prosody table 205 in which the micro-prosody patterns as shown in FIG. 4 are inputted to the synthesized speech identifying apparatus 210, the first vowel rising pattern matches the pattern of the manufacturer A and the first vowel falling pattern matches the pattern of the manufacturer C. However, in the case where the second vowel rising pattern matches the manufacturer A, it is judged that the synthesized speech is synthesized by the speech synthesis apparatus of the manufacturer A. Thus, the only two matches of micro-prosodies can identify that the synthesized speech is synthesized by the speech synthesis apparatus of the manufacturer A. It is because that a probability of matching the micro-prosodies is almost equal to zero even if the same vowel is pronounced in natural speech so that the probability of one match of micro-prosodies is very low.

According to this structure, each manufacturer generates synthesized speech in which micro-prosody patterns specific to the manufacturer are embedded as synthesized speech identification information. Therefore, in order to generate speech by changing only a fine time pattern of a fundamental frequency which cannot be extracted unless analyzing periodicity of the speech, it is necessary to modify a time pattern of a fundamental frequency which can be obtained by analyzing the speech, and to re-synthesize into speech having the modified fundamental frequency and the frequency characteristics of the original speech. Thus, by embedding the identification information as the time pattern of the fundamental frequency, the synthesized speech cannot be modified easily by processing after the synthesized speech generation such as filtering and equalizing for modifying the frequency characteristics of the speech. Also, in the processing after the synthesized speech generation, the identification information cannot be embedded into the synthesized speech, recorded speech and the like which do not include the identification information at the time of generation. Therefore, the identification of the synthesized speech from the speech generated by other methods can be surely performed.

In addition, the speech synthesis apparatus 200 embeds synthesized speech identification information in a main frequency band of the speech signal so that a method of embedding information into speech by which the identification information is unlikely to be modified, the reliability of the identification is high and especially effective for arrogation prevention and the like can be provided. Further, the additional information is embedded in a signal in the main frequency band of the speech called fundamental frequency. Therefore, a method of embedding information into the speech that is robust and highly reliable even for a transmission which does not cause a deterioration of the sound quality due to the information addition and a drop of the identification information due to a narrowness of a band to a transmission line such as a telephone line restricted to a main frequency band of the speech signal, can be provided. Furthermore, a method of embedding information which does not lose the embedded information for rounding at the time of digital/analog conversion, dropping of a signal in the transmission line or mixing of a noise signal, can be provided.

Further, the micro-prosody itself is micro-information whose differences are difficult to be identified by hearing with human ears. Therefore, the information can be embedded into the synthesized speech without causing a deterioration of the sound quality.

It should be noted that while, in the present embodiment, the identification information for identifying a manufacturer of a speech synthesis apparatus is embedded as the additional information, information other than the above such as a model and a synthesis method of the synthesis apparatus may be embedded.

Also, it should be noted that while, in the present embodiment, a macro-pattern of prosody is generated by a prosody pattern of an accent phrase by a unit of mora using a statistical method than natural speech, it may be generated by using a method of learning such as HMM or a method of a model such as a critical damping secondary linear system on a logarithmic axis.

It should be noted that while, in the present embodiment, a segment in which a micro-prosody is set is within 30 msec from a start point of a phoneme or from an end of the phoneme, the segment may be other values unless it is a time range enough for generating micro-prosody. The micro-prosody can be observed within a range from 10 msec to 50 msec (at least two pitches or more) before or after phoneme boundaries. It is known from research papers and the like that it is very difficult to hear the distinction, and is considered that the micro-prosody hardly affect the characteristics of a phoneme. As a practical observation range of micro-prosody, a range between 20 msec to 50 msec is considered. The maximum value is set to 50 msec because experience shows that the length longer than 50 msec may exceed a length of a vowel.

It should be noted that, while, in the present embodiment, patterns match when a relative coefficient of a relative fundamental frequency for each one frame is 0.95 or greater, other matching method may be also used.

It should be noted that, while, in the present embodiment, the input speech is identified as a synthesized speech by a speech synthesis apparatus of a particular manufacturer if the number of times when the fundamental frequency patterns match micro-prosody patterns corresponding to the manufacturer is twice or more. However, the identification can be made based on other standards.

Second Embodiment

Figure 9:
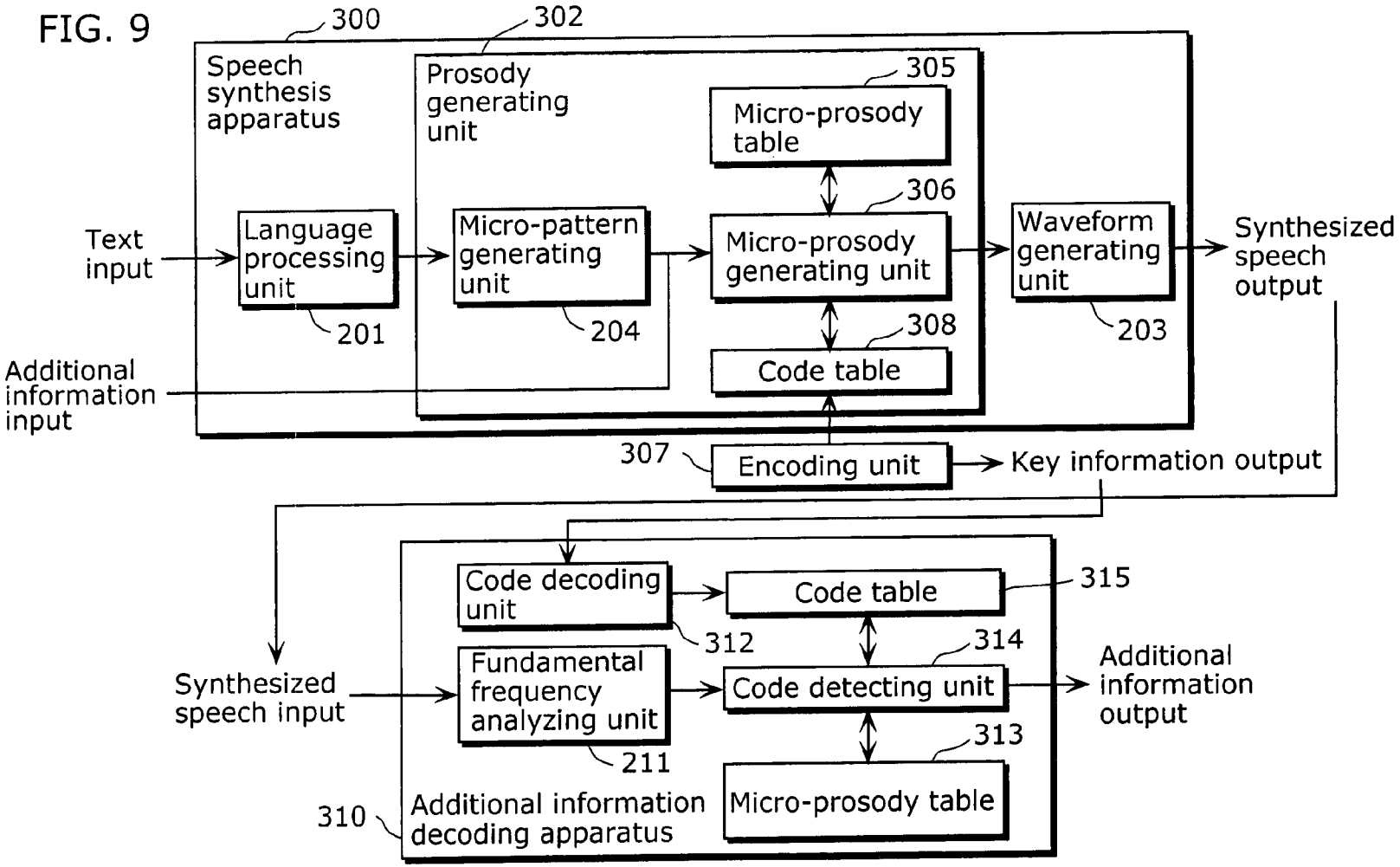
FIG. 9 is a functional block diagram showing a speech synthesis apparatus and an additional information decoding apparatus according to a second embodiment of the present invention.
Figure 10:
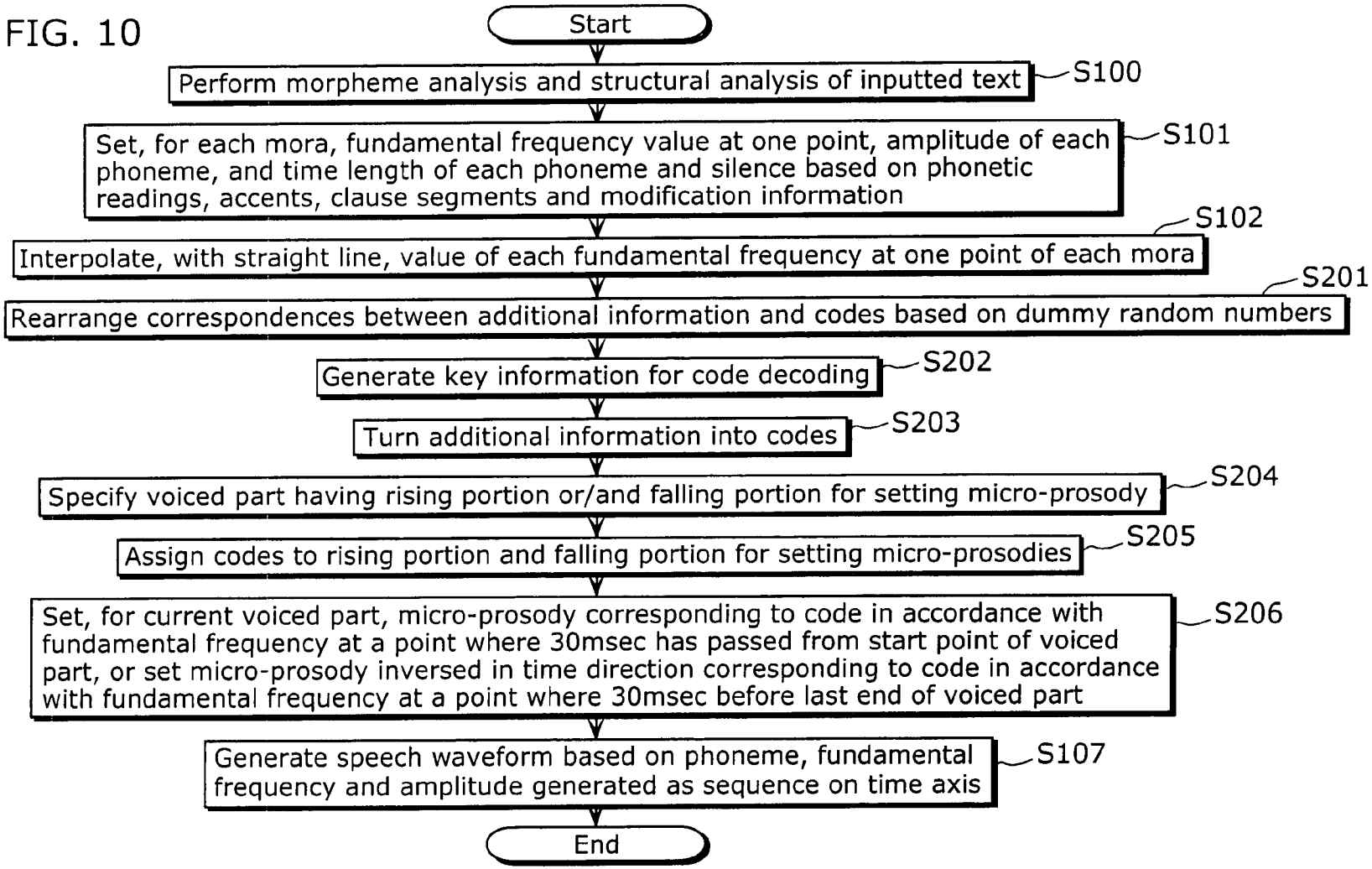
FIG. 10 is a flowchart showing operations of the speech synthesis apparatus according to the second embodiment of the present invention.
Figure 13:
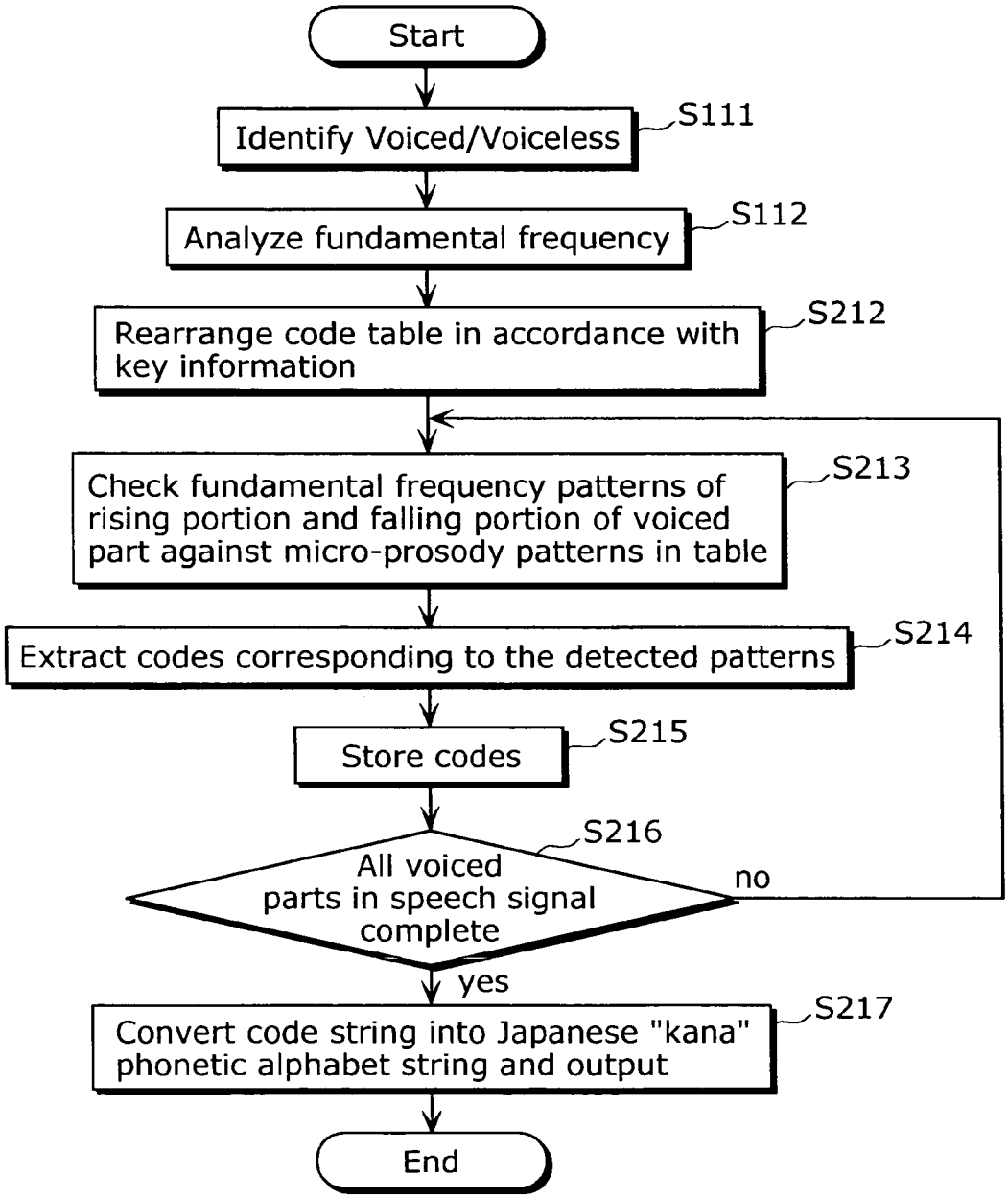
FIG. 13 is a flowchart showing operations by the additional information decoding apparatus according to the second embodiment of the present invention.

FIG. 9 is a functional block diagram showing a speech synthesis apparatus and an additional information decoding apparatus according to the second embodiment of the present invention. FIG. 10 is a flowchart showing operations of the speech synthesis apparatus. FIG. 13 is a flowchart showing operations of the additional information decoding apparatus. In FIG. 9, same reference numbers are assigned to constituents that are the same in FIG. 2, and the explanations about the same constituents are omitted here.

In FIG. 9, a speech synthesis apparatus 300 is an apparatus which converts inputted text into speech. It is made up of a language processing unit 201, a prosody generating unit 302, and a waveform generating unit 303. The prosody generating unit 302 determines a fundamental frequency, speech strength, rhythm, and timing and duration length of posing of synthesis speech to be generated based on phonetic readings, accents' positions, clause segments and modification information outputted by the language processing unit 201, and outputs a fundamental frequency pattern, strength pattern and duration length of each mora.

The prosody generating unit 302 is made up of a macro-pattern generating unit 204, a micro-prosody table 305 in which micro-time structure (micro-prosody) patterns near phoneme boundaries are recorded in association with codes which indicate additional information, a code table 308 in which additional information and corresponding codes are recorded, and a micro-prosody generating unit 306 which applies a micro-prosody corresponding to a code of the additional information to a fundamental frequency and speech strength at a central point of a duration of a phoneme outputted by the macro-pattern generating unit 204, and generates a prosody pattern in each phoneme. Further, an encoding unit 307 is set outside the audio synthesis apparatus 300. The encoding unit 307 encodes the additional information by changing a correspondence between the additional information and the code indicating the additional information using a dummy random number, and generates key information for decoding the encoded information.

The additional information decoding apparatus 310 extracts and outputs the additional information embedded in speech using the inputted speech and the key information. It is made up of a fundamental frequency analyzing unit 211, a code decoding unit 312 which generates a correspondence of a Japanese "kana" phonetic alphabet and a code with the key information outputted by the coding processing unit 307 as an input, a code table 315 in which the correspondences of the Japanese "kana" phonetic alphabets and codes are recorded, a micro-prosody table 313 in which the micro-prosody patterns and the corresponding codes are recorded together, and a code detecting unit 314 which generates a code with reference to the micro-prosody table 313 from the micro-prosody included in a time pattern of the fundamental frequency outputted from the fundamental frequency analyzing unit 211.

Figure 11:
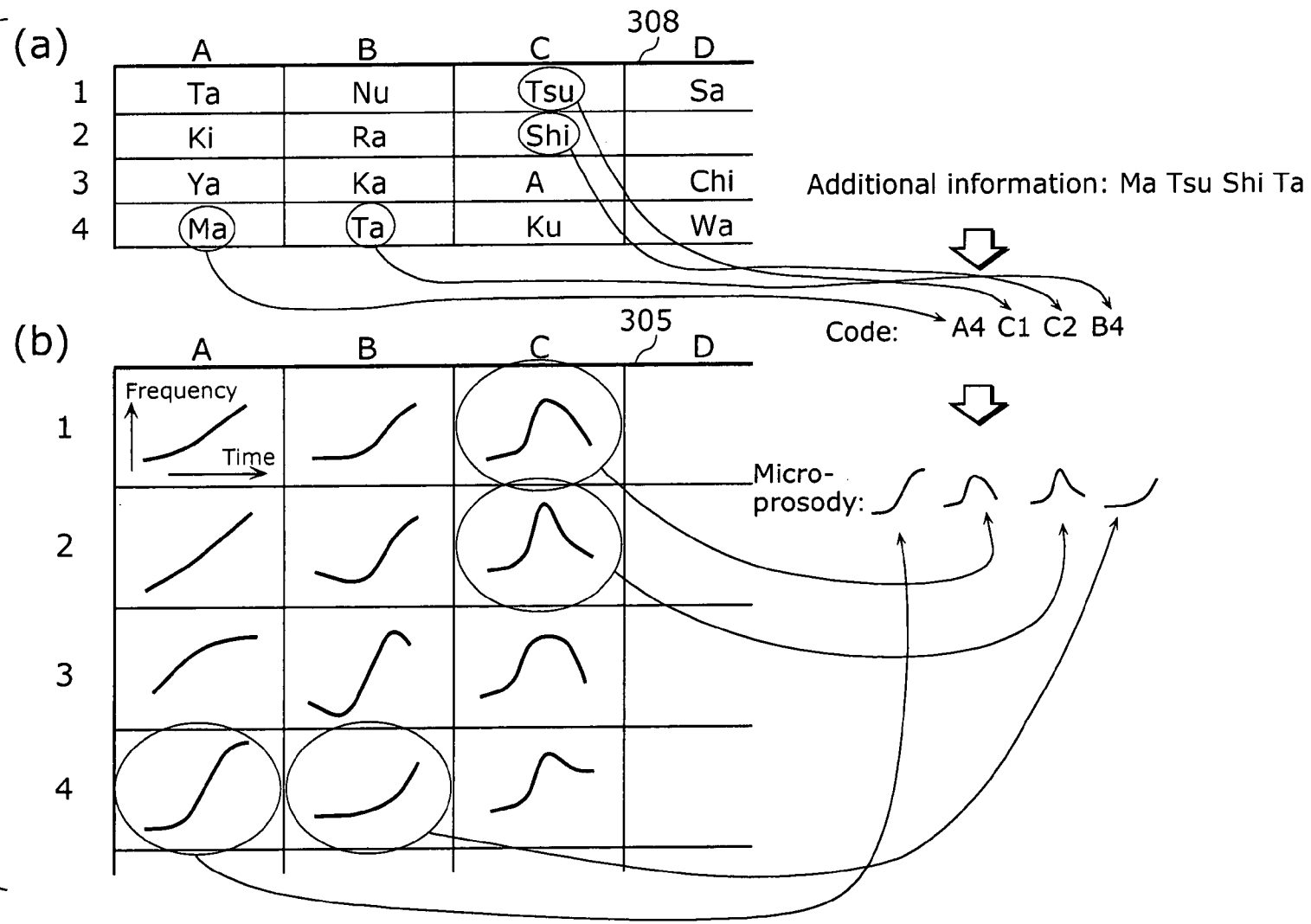
FIG. 11 is a diagram showing an example of correspondences between additional information and codes recorded in a code table and an example of correspondences between micro-prosodies and codes recorded in the micro-prosody table, in the speech synthesis apparatus according to the second embodiment of the present invention.
Figure 12:
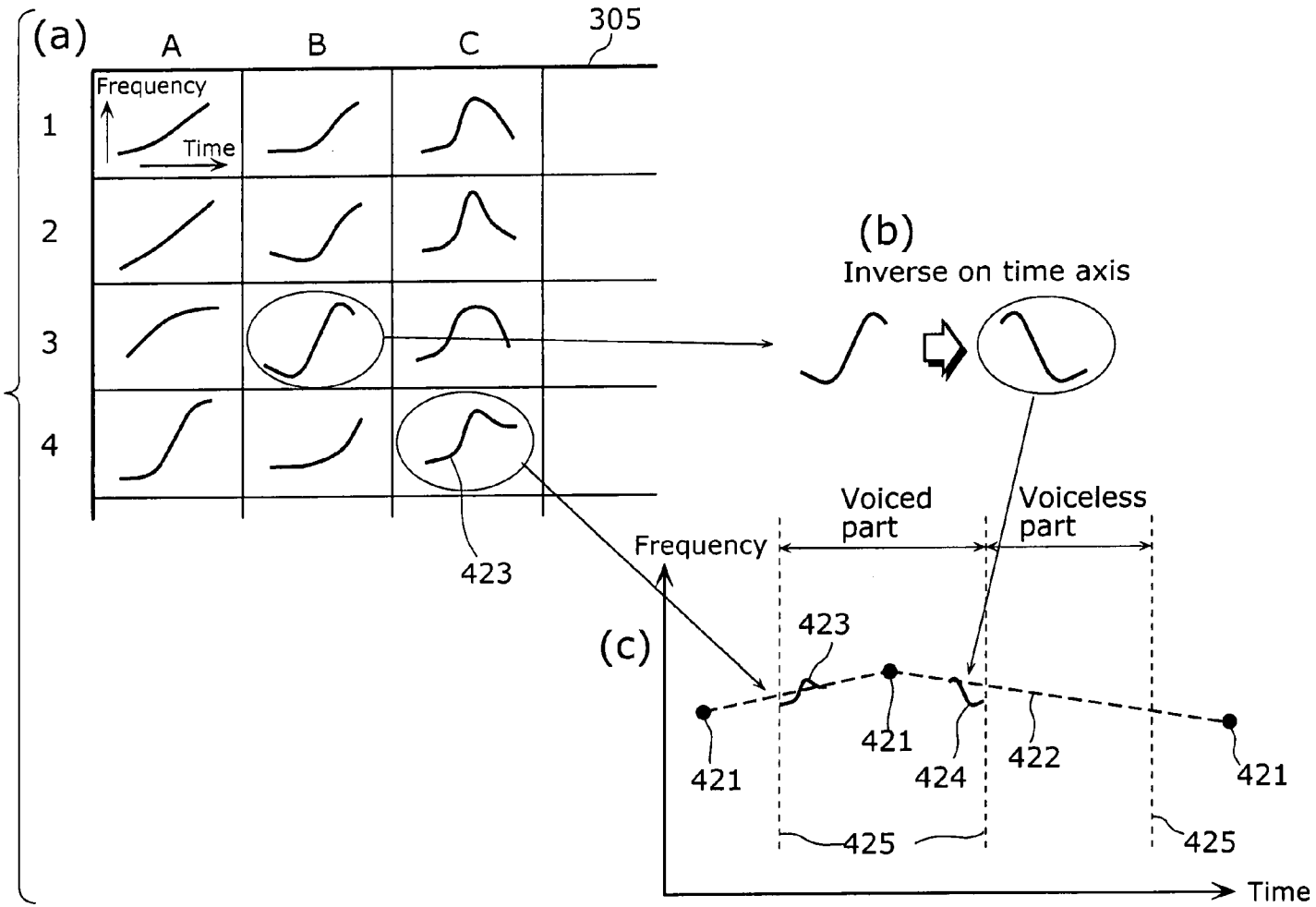
FIG. 12 is a schematic diagram showing a micro-prosody generation by the speech synthesis apparatus according to the second embodiment of the present invention.

Next, the operations of the speech synthesis apparatus 300 and the additional information decoding apparatus 310 are explained following the flowcharts of FIG. 10 and FIG. 13. Further, FIG. 11 and FIG. 12 are used for references. FIG. 11 is a diagram showing an example of coding using "Ma Tsu Shi Ta" as an example and micro-prosodies of a voiced sound rising portion and codes associated with each of the micro-prosody patterns that are stored in the micro-prosody table 305. FIG. 12 is a schematic diagram showing a method of applying a micro-prosody of a voiced sound rising portion stored in the micro-prosody table 305 to a voiced sound falling portion.

FIG. 11(*a*) is a diagram showing an example of the code table 308 in which each code, which is a combination of a row character and a column number, is associated with a Japanese "kana" phonetic alphabet that is the additional information. FIG. 11(*b*) is a diagram showing an example of the micro-prosody table 305 in which each code, which is a combination of a row character and a column number, is associated with micro-prosody. Based on the code table 308, the Japanese "kana" phonetic alphabets that are additional information are converted into codes. Further, based on the micro-prosody table 305, the codes are converted into micro-prosodies. FIG. 12 is a schematic diagram showing a method of generating micro-prosody using an example in the case where the micro-prosody of code B3 is applied to a voiced sound rising portion and the micro-prosody of code C3 is applied to a voiced sound falling portion. FIG. 12(*a*) is a diagram showing the micro-prosody table 305. FIG. 12(*b*) is a diagram showing inverse processing of the micro-prosody on a time axis. FIG. 12(*c*) is a graph showing, on a coordinate in which time is indicated by horizontal axis and frequency is indicated by vertical axis, patterns of fundamental frequencies in a portion of speech to be synthesized. In this graph, a boundary between voiced and voiceless sounds is indicated by a dashed line. Also, black dots 421 indicate fundamental frequencies in a unit of mora generated by the macro-pattern generating unit 204. The curved lines 423 and 424 by solid lines indicate micro-prosodies generated by the micro-prosody generating unit 306.

First, in the speech synthesis apparatus 300, as similar in the first embodiment, the language processing unit 201 performs morpheme analysis and structure analysis of the inputted text, and outputs clause segments and modification information (step S100). The macro-pattern generating unit 204 sets a fundamental frequency, speech strength at a center point of a vowel included in each mora, and duration length of the mora (step S101). A prosody pattern generated at one point per mora is interpolated by a straight line, and a fundamental frequency at each point within the mora is obtained (step S102).

On the other hand, the encoding unit 307 rearranges, using dummy random numbers, correspondences of Japanese "kana" phonetic alphabets with codes for indicating a Japanese "kana" phonetic alphabet that is additional information by one code, and records, on the code table 308, the correspondences of the Japanese "kana" phonetic alphabets with codes (A1, B1, C1 . . . ) as shown in FIG. 11(*a*) (step S201).

Further, the encoding unit 307 outputs, as key information, the correspondence of a Japanese "kana" phonetic alphabet with a code as shown in FIG. 11(*a*) (step S202).

The micro-prosody generating unit 306 codes the additional information which should be embedded into the inputted speech signal (step S203). FIG. 11 shows an example of coding of the additional information "Ma Tsu Shi Ta". A code which corresponds to each Japanese "kana" phonetic alphabet is extracted by referring to the additional information made of a Japanese "kana" phonetic alphabet to the correspondence of the Japanese "kana" phonetic alphabet with a code stored in the code table 308. With reference to the example of "Ma Tsu Shi Ta", in FIG. 11(*a*), "Ma" "Tsu" "Shi" "Ta" respectively correspond to "A4", "C1", "C2" and "B4". Accordingly, the code corresponding to "Ma Tsu Shi Ta" is "A4 C1 C2 B4". The micro-prosody generating unit 306 specifies voiced parts in the speech to be synthesized (step S204), and assigns one each piece of the additional information coded in S203, from a head of the speech, to segments of the voiced part from a segment of 30 msec from the start point of the voiced part to a segment of 30 msec of the last end of the voiced part (step S205).

For each voiced part specified in S204, a micro-prosody pattern corresponding to the code assigned in S205 is extracted with reference to the micro-prosody table 305 (step S206). For example, as shown in FIG. 11, micro-prosodies corresponding to the code "A4 C1 C2 B4" generated in S203 which matches "Ma Tsu Shi Ta" are extracted. In a segment of 30 msec from the start point of the voiced part, in the case where, as shown in FIG. 11(*b*), the micro-prosody patterns include only upward patterns for the start point of the voiced part as a whole, as shown in FIG. 12, a micro-prosody pattern corresponding to the codes assigned in S205 is extracted (FIG. 12(*a*)), the end of the extracted micro-prosody pattern is connected so as to match a fundamental frequency at a point of 30 msec from the start point of the voiced part (FIG. 12(*c*)), and the micro-prosody 423 at the start point of the voiced part is set. Further, in a segment of 30 msec until the end of the voiced part, as shown in FIG. 12(*a*), micro-prosody corresponding to the code assigned in S205 is extracted, the extracted micro-prosody is inverted in a temporal direction as shown in FIG. 12(*b*), a downward micro-prosody pattern as a whole is generated, a head of the micro-prosody pattern is connected so as to match a value of a micro-prosody pattern at 30 msec preceding to the last end of the voiced part as shown in FIG. 12(*c*), and micro-prosody 424 of the vowel falling portion is set. The micro-prosody generating unit 206 outputs the fundamental frequency including micro-prosodies generated in S206, speech strength generated by the macro-pattern generating unit 204, and duration length of mora, together with a mora sequence.

The waveform generating unit 203 generates a waveform using a waveform superimposition method or a sound source filter model and the like from the fundamental frequency pattern including micro-prosodies outputted from the micro-prosody generating unit 306, the speech strength generated by the macro-pattern generating unit 204, duration length of mora and the mora sequence (step S107).

Next, the additional information decoding apparatus 310 judges whether the inputted speech is voiced sound or voiceless sound, and divides into voiced parts and voiceless parts (step S111). Further, the fundamental frequency analyzing unit 211 analyzes the fundamental frequency of the voiced part judged in S111, and obtains a value of the fundamental frequency for each analysis frame (step S112). On the other hand, a code decoding unit 312 corresponds the Japanese "kana" phonetic alphabet, that is additional information, with a code based on the inputted key information, and records the correspondence onto the code table 314 (step S212). The code detecting unit 314 specifies, for the fundamental frequency of the voiced part of the inputted speech extracted in S112, a micro-prosody pattern matching the fundamental frequency pattern of the voiced part with reference to the micro-prosody table 313 from the head of the speech (step S213), extracts a code corresponding to the specified micro-prosody pattern (step S214), and records the code sequence (step S215). The judgment of matching is same as described in the first embodiment. The code detecting unit 314, in the case of S213 when the fundamental frequency pattern of the voiced part is checked against the micro-prosody patterns recorded in the micro-prosody table 313, checks it against a pattern for a start point of the voiced part recorded in the micro-prosody table 313 in a segment of 30 msec from the start point of the voiced part, and extracts the code corresponding to the matched pattern. Also, in a segment of 30 msec until the last end of the voiced part, the code detecting unit 314 checks the fundamental frequency pattern against a pattern for the last end of the voiced part recorded in the micro-prosody table 313 that is a pattern obtained by inversing the pattern for the start of the voiced part in a temporal direction, and extracts a code corresponding to the matched pattern. In the case of S216 when it is judged that the current voiced part is the last voiced part in the inputted speech signal (yes in step S216), the code detecting unit converts, with reference to the code table 315, an arrangement of codes corresponding to the micro-prosodies that are arranged sequentially from the head of the speech and recorded, into a Japanese "kana" phonetic alphabet sequence that is additional information, and outputs the Japanese "kana" phonetic alphabet sequence (step S217). In the case of S216 when it is judged that the voiced part is not the last voiced part in the inputted speech signal (no in step S216), the code detecting unit performs operations from S213 to S215 on the next voiced part on the temporal axis of the speech signal. After the operations from S213 to S215 are performed on all voiced parts in the speech signal, the arrangement of codes corresponding to the micro-prosodies in the inputted speech is converted into a Japanese "kana" phonetic sequence and the Japanese "kana" phonetic sequence is outputted.

According to the mentioned structure, the following method of embedding information into speech with high credibility against modification can be provided. By the method, the synthesized speech cannot be easily modified by processing such as filtering and equalizing after the synthesized speech is generated by generating the synthesized speech in which a micro-prosody pattern indicating the additional information corresponding to a specific code is embedded, further changing the correspondence of the additional information with the code using dummy random numbers every time when the synthesis processing is executed, and separately generating key information indicating the correspondence of the additional information with the code. In addition, since information is embedded as a micro-prosody pattern that is a fine time structure of the fundamental frequency, the additional information is embedded in a main frequency band of the speech signal. Therefore, the following method of embedding information into the speech can be provided. The method is highly reliable even for a transmission which does not cause a deterioration of the sound quality due to the embedment of the additional information and a drop of the additional information due to narrowness of a band to a transmission line such as a telephone line restricted to a main frequency band of the speech signal. Further, a method of embedding information which does not lose the embedded information for rounding at the time of digital/analog conversion, dropping of a signal in the transmission line or mixing of a noise signal, can be provided. Furthermore, the confidentiality of information can be increased by encoding the additional information by changing the correspondence relationship between code and additional information corresponding to a micro-prosody using random numbers for each operation of speech synthesis, generating a state in which the encoded additional information can be decoded only by an owner of key information for decoding. It should be noted that while, in the present embodiment, the additional information is encoded by changing, using dummy random numbers, the correspondence of the Japanese "kana" phonetic alphabet that is additional information with a code, other methods such as changing a correspondence of a code with a micro-prosody pattern may be used for encoding the correspondence relationship between the micro-prosody pattern and the additional information. Also, it should be noted that while, in the present embodiment, the additional information is the Japanese "kana" phonetic alphabet sequence, other types of information such as alphanumeric characters may be used.

It should be noted that while, in the present embodiment, the encoding processing unit 307 outputs a correspondence of a Japanese "kana" phonetic alphabet with a code as key information, other information may be used unless the information is by which a correspondence of a Japanese "kana" phonetic alphabet with a code used for generating a synthesized speech by the speech synthesis apparatus 300 can be reconstructed in the additional information decoding apparatus 310, such as outputting a number for selecting a code from multiple correspondence tables that are previously prepared, or outputting an initial value for generating a correspondence table.

It should be noted that while, in the present embodiment, a micro-prosody pattern of a last end of a voiced part is a micro-prosody pattern of a start point of the voiced part that is inverted in a temporal direction and both micro-prosody patterns correspond to a same code, separate micro-prosody patterns may be set at the start point of the voiced part and the last end of the voiced part.

Also, it should be noted that while, in the present embodiment, a macro-pattern of prosody is generated by a prosody pattern of an accent phrase in a unit of mora using a statistical method than natural speech, it may be generated by using a method of learning such as HMM or a method of a model such as critical damping secondary linear system on a logarithmic axis.

It should be noted that while, in the present embodiment, a segment in which a micro-prosody is set within 30 msec from a start point of a phoneme or from an end of the phoneme, the segment may be other values unless it is a time range enough for generating micro-prosody.

It should be noted that, as a rising portion or a falling portion of setting micro-prosody, the micro-prosody may be set in the following segments including the explanations of step S103 and S105 in FIG. 3 and step S205 in FIG. 10. In other words, the micro-prosody may be set, in a segment in a predetermined time length within a phoneme length including a phoneme boundary, and in a segment in a predetermined time length from a start point of voiced sound immediately preceded by a voiceless sound, a segment of a predetermined time length until a last end of voiced sound immediately followed by voiceless sound, a segment of a predetermined time length from a start point of voiced sound of the voiced sound immediately preceded by silence, a segment of a predetermined time length by a last end of voiced sound of the voiced sound immediately followed by silence, a segment of a predetermined time length from a start point of a vowel immediately preceded by a consonant, a segment of a predetermined time length until a last end of a vowel immediately followed by a consonant, a segment of a predetermined time length from a start point of a vowel immediately preceded by silence, or a segment of a predetermined time length until a last end of vowel immediately followed by silence.

Note that, in the first and second embodiments, information is embedded in a time pattern of a fundamental frequency in predetermined segments before and after a phoneme boundary by associating with a symbol called micro-prosody. The segment may be segments other than the above segment unless it is a segment in which a human is unlikely to realize a change of prosody, an area in which a human does not feel uncomfortable by the modification of the phoneme, or a segment in which deteriorations of sound quality and clarity are not sensed.

It should be noted that the present invention may be applied to languages other than Japanese.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

A method of embedding information into synthesized speech and a speech synthesis apparatus which can embed information according to the present invention include a method or a unit of embedding information into prosody of synthesized speech, and are effective as an addition of watermark information into a speech signal and the like. Further, they are applicable for preventing arrogation and the like.

What is claimed is:

1. A speech synthesis apparatus which synthesizes speech, said apparatus comprising:

a prosody generating unit for generating prosody information of the speech based on synthesized speech generation information; and a synthesis unit for synthesizing the speech based on the prosody information, wherein said prosody generation unit is for:

specifying a time position including a phoneme boundary in the speech to be synthesized into which a micro-prosody pattern is to be embedded, based on the synthesized speech generation information;

extracting a micro-prosody pattern from a storage unit, the micro-prosody pattern being a pattern of a fine time structure of prosody including the phoneme boundary; and embedding the extracted micro-prosody pattern into the specified time position as watermark information, the embedded micro-prosody pattern indicating that the speech is synthesized speech.

2. The speech synthesis apparatus according to claim 1, wherein a duration for embedding the extracted micro-prosody pattern is a duration in a range from 10 milliseconds to 50 milliseconds.

3. The speech synthesis apparatus according to claim 1, further comprising an encoding unit for encoding additional information, wherein said encoding unit is for encoding information for associating the micro-prosody pattern stored in said storage unit with the additional information, and wherein said prosody generation unit is for selecting from the storage unit, based on the encoded information, the micro-prosody pattern associated with the additional information, and embedding the selected micro-prosody pattern into the specified time position including the phoneme boundary.

4. The speech synthesis apparatus according to claim 3, wherein said encoding unit is further for generating key information which corresponds to the encoded information for decoding the additional information.

5. A synthesis speech identifying apparatus which identifies whether or not inputted speech is synthesized speech, said apparatus comprising:

a fundamental frequency calculating unit for calculating a speech fundamental frequency of the inputted speech on a per frame basis, each frame having a predetermined duration;

a storage unit in which a micro-prosody pattern is stored, the micro-prosody pattern being a pattern of a fine time structure of prosody including a phoneme boundary, and being used to identify the inputted speech as synthesized speech; and an identifying unit for:

extracting, in a segment having a duration including a phoneme boundary within which a micro-prosody pattern of the inputted speech exists as watermark information, the fundamental frequency of the speech calculated by said fundamental frequency calculation unit;

matching a pattern of the extracted fundamental frequency with the micro-prosody pattern stored in said storage unit; and identifying whether or not the inputted speech is synthesized speech.

6. An additional information reading apparatus which decodes additional information embedded in inputted speech, said apparatus comprising:

a fundamental frequency calculating unit for calculating a speech fundamental frequency of the inputted speech on a per frame basis, each frame having a predetermined duration;

a storage unit in which a micro-prosody pattern associated with the additional information is stored, the micro-prosody pattern being a pattern of a fine time structure of prosody including a phoneme boundary; and an additional information extracting unit for:

extracting, in a segment having a duration including a phoneme boundary within which a micro-prosody pattern of the inputted speech exists as water mark information, a micro-prosody pattern from the speech fundamental frequency calculated by said fundamental frequency calculating unit;

comparing the extracted micro-prosody pattern with the micro-prosody pattern associated with the additional information; and extracting predetermined additional information included in the extracted micro-prosody pattern.

7. The additional information reading apparatus according to claim 6, wherein the additional information is encoded, and said additional information reading apparatus further comprises a decoding unit for decoding the encoded additional information using key information for decoding.

8. A speech synthesis method of synthesizing speech, comprising generating prosody information of the speech based on synthesized speech generation information, wherein said generating includes:

specifying a time position including a phoneme boundary in the speech to be synthesized into which a micro-prosody pattern is to be embedded, based on the synthesized speech generation information;

extracting a micro-prosody pattern from a storage unit, the micro-prosody pattern being a pattern of a fine time structure of prosody including the phoneme boundary; and embedding the extracted micro-prosody pattern into the specified time position as watermark information, the embedded micro-prosody pattern indicating that the speech is synthesized speech.

9. The speech synthesis method according to claim 8, wherein a duration for embedding the extracted micro-prosody pattern is a duration in a range from 10 milliseconds to 50 milliseconds.

10. A program embodied on a computer readable recording medium, for making a computer function as a speech synthesis apparatus, said program making the computer function as the following:

a prosody generating unit for generating prosody information of speech based on synthesized speech generation information; and a synthesis unit for synthesizing the speech based on the prosody information, wherein the prosody generating unit is for:

specifying a time position including a phoneme boundary in the speech to be synthesized into which a micro-prosody pattern is to be embedded, based on the synthesized speech generation information;

extracting a micro-prosody pattern from a storage unit, the micro-prosody pattern being a pattern of a fine time structure of prosody including the phoneme boundary; and embedding the extracted micro-prosody pattern into the specified time position as watermark information, the embedded micro-prosody pattern indicating that the speech is synthesized speech.

11. The program embodied on a computer readable recording medium, according to claim 10, wherein a duration for embedding the extracted micro-prosody pattern is a duration in a range from 10 milliseconds to 50 milliseconds.

12. A computer readable recording medium on which a program for making a computer function as a speech synthesis apparatus is recorded, wherein said program makes a computer function as the following:

a prosody generating unit for generating prosody information of speech based on synthesized speech generation information; and a synthesis unit for synthesizing the speech based on the prosody information, wherein the prosody generating unit is for:

specifying a time position including a phoneme boundary in the speech to be synthesized into which a micro-prosody pattern is to be embedded, based on the synthesized speech generation information;

extracting a micro-prosody pattern from a storage unit, the micro-prosody pattern being a pattern of a fine time structure of prosody including the phoneme boundary; and embedding the extracted micro-prosody pattern into the specified time position as watermark information, the embedded micro-prosody pattern indicating that the speech is synthesized speech.

13. The computer readable recording medium according to claim 12, wherein a duration for embedding the extracted micro-prosody pattern is a duration in a range from 10 milliseconds to 50 milliseconds.

14. The speech synthesis apparatus according to claim 1, wherein said prosody generating unit is for identifying, as the time position including the phoneme boundary in the speech to be synthesized, a portion of at least one vowel of: a vowel which follows immediately after silence; a vowel which follows immediately after a consonant other than a semivowel; a vowel which immediately precedes silence; and a vowel which immediately precedes a consonant other than a semivowel.

15. The speech synthesis apparatus according to claim 1, wherein said prosody generating unit is for identifying, as the time position including the phoneme boundary in the speech to be synthesized, at least one of: a portion, including a starting point of a phoneme, of a vowel which follows immediately after silence; a portion, -including the starting point of the phoneme, of a vowel which follows immediately after a consonant other than a semivowel; a portion, including an ending point of the phoneme, of a vowel which immediately precedes silence; and a portion, including the ending point of the phoneme, of a vowel which immediately precedes a consonant other than a semivowel.

16. A speech synthesis apparatus which synthesizes speech, said apparatus comprising:

a prosody generating unit for generating prosody information of the speech based on synthesized speech generation information; and a synthesis unit for synthesizing the speech based on the prosody information, wherein said prosody generation unit is for:

specifying a time position in the speech to be synthesized into which a micro-prosody pattern is to be embedded, based on the synthesized speech generation information;

extracting a micro-prosody pattern from a storage unit, the micro-prosody pattern being a pattern of a fine time structure of prosody including a phoneme boundary; and embedding the extracted micro-prosody pattern into the specified time position as watermark information, the embedded micro-prosody pattern indicating that the speech is synthesized speech, and the embedded micro-prosody pattern being used to identify a manufacturer of said speech synthesis apparatus.

17. A synthesis speech identifying apparatus which identifies whether or not inputted speech is synthesized speech, said apparatus comprising:

a fundamental frequency calculating unit for calculating a speech fundamental frequency of the inputted speech on a per frame basis, each frame having a predetermined duration;

a storage unit in which a micro-prosody pattern is stored, the micro-prosody pattern being a pattern of a fine time structure of prosody including a phoneme boundary, and the micro-prosody pattern being used to identify the inputted speech as synthesized speech and to identify a manufacturer of said speech synthesis apparatus that has generated the synthesized speech; and an identifying unit for:

extracting, in a segment having a duration within which a micro-prosody pattern of the inputted speech exists as watermark information, the fundamental frequency of the speech calculated by said fundamental frequency calculation unit;

matching a pattern of the extracted fundamental frequency with the micro-prosody pattern stored in said storage unit; and identifying whether or not the inputted speech is synthesized speech and, in the case where the inputted speech is synthesized speech, identify a manufacturer of said speech synthesis apparatus that has generated the synthesized speech.

18. An additional information reading apparatus which decodes additional information embedded in inputted speech, said apparatus comprising:

a fundamental frequency calculating unit for calculating a speech fundamental frequency of the inputted speech on a per frame basis, each frame having a predetermined duration;

a storage unit in which a micro-prosody pattern associated with the additional information is stored, the micro-prosody pattern being a pattern of a fine time structure of prosody including a phoneme boundary, and the micro-prosody pattern being used to identify a manufacturer of said speech synthesis apparatus; and an additional information extracting unit for:

extracting, in a segment having a duration including a phoneme boundary within which a micro-prosody pattern of the inputted speech exists as watermark information, a micro-prosody pattern from the speech fundamental frequency calculated by said fundamental frequency calculating unit;

comparing the extracted micro-prosody pattern with the micro-prosody pattern associated with the additional information;

extracting predetermined additional information included in the extracted micro-prosody pattern; and identifying a manufacturer of said speech synthesis apparatus that has generated the synthesized speech.

* * * * *